US009638191B2

(12) United States Patent
Stover

(10) Patent No.: US 9,638,191 B2
(45) Date of Patent: May 2, 2017

(54) CAPACITY MODULATED SCROLL COMPRESSOR

(71) Applicant: Emerson Climate Technologies, Inc., Sidney, OH (US)

(72) Inventor: Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 176 days.

(21) Appl. No.: 14/450,748

(22) Filed: Aug. 4, 2014

(65) Prior Publication Data

US 2016/0032924 A1 Feb. 4, 2016

(51) Int. Cl.

| | |
|---|---|
| ***F04C 18/02*** | (2006.01) |
| ***F04C 28/26*** | (2006.01) |
| ***F04C 29/12*** | (2006.01) |
| ***F04C 27/00*** | (2006.01) |
| *F04C 23/00* | (2006.01) |

(52) U.S. Cl.

CPC ..... *F04C 18/0261* (2013.01); *F04C 18/0215* (2013.01); *F04C 27/005* (2013.01); *F04C 28/26* (2013.01); *F04C 28/265* (2013.01); *F04C 23/008* (2013.01); *F04C 29/12* (2013.01); *F04C 2270/58* (2013.01)

(58) Field of Classification Search

CPC .. F04C 18/0215; F04C 28/26; F04C 18/0261; F04C 2270/58; F04C 28/265; F04C 29/12

See application file for complete search history.

(56) References Cited

U.S. PATENT DOCUMENTS 5,613,841 A * 3/1997 Bass ..... F01C 21/102 417/310
5,741,120 A * 4/1998 Bass ..... A47F 3/04 417/214
6,213,731 B1 4/2001 Doepker et al.

(Continued)

OTHER PUBLICATIONS

Written Opinion of the International Searching Authority regarding International Application No. PCT/US2015/043426, dated Oct. 19, 2015.

(Continued)

*Primary Examiner* — Mark Laurenzi
*Assistant Examiner* — Wesley Harris
(74) *Attorney, Agent, or Firm* — Harness, Dickey & Pierce, P.L.C.

(57) ABSTRACT

A compressor may include a first scroll member having a first spiral wrap, a first chamber, and a first aperture. A second scroll member may include a second spiral wrap engaged with the first spiral wrap to form a series of compression pockets and a second aperture. The first aperture may be in communication with a first of the compression pockets to provide communication between the first compression pocket and the first chamber. The second aperture may be in communication with a second of the compression pockets. A capacity modulation assembly may include a first piston preventing communication between the first aperture and a first passage when in a first position and providing communication when in a second position. A second piston may prevent communication between the second aperture and a third passage when in the first position, and provide communication when in a second position.

21 Claims, 10 Drawing Sheets

(56) References Cited

U.S. PATENT DOCUMENTS

| | | | | |
|---|---|---|---|---|
| 7,972,125 | B2 * | 7/2011 | Stover | F04C 18/0215 417/299 |
| 7,976,296 | B2 | 7/2011 | Stover et al. | |
| 8,568,118 | B2 * | 10/2013 | Stover | F04C 18/0215 418/55.5 |
| 8,790,098 | B2 * | 7/2014 | Stover | F04C 18/0215 417/307 |
| 2009/0185935 | A1 * | 7/2009 | Seibel | F04C 18/0215 418/55.4 |
| 2009/0297378 | A1 * | 12/2009 | Stover | F04C 18/0215 418/55.1 |
| 2009/0297379 | A1 * | 12/2009 | Stover | F04C 18/0215 418/55.1 |
| 2011/0058972 | A1 | 3/2011 | Patel et al. | |
| 2011/0135509 | A1 | 6/2011 | Fields et al. | |
| 2012/0107163 | A1 * | 5/2012 | Monnier | F04C 18/0215 418/1 |
| 2014/0064999 | A1 | 3/2014 | Magadum et al. | |

OTHER PUBLICATIONS

International Search Report regarding International Application No. PCT/US2015/043426, dated Oct. 19, 2015.

* cited by examiner

CAPACITY MODULATED SCROLL COMPRESSOR

FIELD

The present disclosure relates to compressors, and more specifically to compressors having capacity modulation systems.

BACKGROUND

This section provides background information related to the present disclosure which is not necessarily prior art.

Scroll compressors include a variety of capacity modulation mechanisms to vary operating capacity of the compressor. The capacity modulation mechanisms may include fluid passages extending though a scroll member to selectively provide fluid communication between compression pockets and another pressure region of the compressor.

SUMMARY

This section provides a general summary of the disclosure, and is not a comprehensive disclosure of its full scope or all of its features.

In one form, a compressor is provided and may include a housing having a discharge pressure region and a suction pressure region. A first scroll member may be supported within the housing and may have a first end plate, a first spiral wrap extending from a first side of the first end plate, a first chamber located on a second side of the first end plate having first and second passages in communication therewith, and a first aperture extending through the first end plate and in communication with the first chamber. A second scroll member may be supported within the housing and may include a second end plate having a second spiral wrap extending therefrom that is meshingly engaged with the first spiral wrap to form a series of compression pockets and a second aperture extending therethrough. The first aperture may be in communication with a first of the compression pockets to provide communication between the first compression pocket and the first chamber. The second aperture may be in communication with a second of the compression pockets.

A capacity modulation assembly may include a first piston located within the first chamber and displaceable between first and second positions. The first piston may prevent communication between the first aperture and the first passage when in the first position, and the first piston may provide communication between the first aperture and the first passage when in the second position. A structure may support the second scroll member for orbital displacement relative to the first scroll member and may include a recess generally aligned with the second aperture and third and fourth passages in communication with the recess. A second piston may be located within the recess and may be axially displaceable between first and second positions. The second piston may prevent communication between the second aperture and the third passage when in the first position, and the second piston may provide communication between the second aperture and the third passage when in the second position.

In some embodiments, a floating seal assembly may be engaged with the housing and the first scroll member to isolate the discharge pressure region from the suction pressure region.

In some embodiments, the first piston is located axially between the floating seal assembly and the first end plate.

In some embodiments, the first piston is axially displaceable relative to the floating seal assembly.

In some embodiments, a biasing member biases the first piston toward the second position.

In some embodiments, the first passage extends radially through the first scroll member and into the first chamber, the second passage extends radially through the first scroll member and into the first chamber, the third passage extends radially through the second scroll member and into the recess, and the fourth passage extends radially through the second scroll member and into the recess.

In some embodiments, the first piston abuts the first end plate when in the first position.

In some embodiments, a solenoid may include a communication passage selectively providing communication between the second passage and an annular recess. When the solenoid provides communication between the second passage and the annular recess, the first piston may be in the first position, and when the solenoid prevents communication between the second passage and the annular recess, the first piston may be in the second position.

In some embodiments, a valve assembly may be in communication with the second passage and may selectively provide a pressurized fluid to the second passage to bias the first piston toward the first end plate.

In some embodiments, the first chamber may be an annular chamber, the recess may be an annular recess, the first piston may be an annular piston, and the second piston may be an annular piston.

In some embodiments, the first scroll member may be a non-orbiting scroll, and the second scroll member may be an orbiting scroll.

In some embodiments, the first passage may be in communication with the suction pressure region.

In some embodiments, the third passage may be in communication with the suction pressure region.

In some embodiments, a valve mechanism may be in communication with the fourth passage and may selectively provide a pressurized fluid to the fourth passage to bias the second piston toward the second end plate.

In some embodiments, the second piston may abut the second end plate when in the first position.

In some embodiments, a valve operable in a pulse width modulation capacity mode may operate the compressor at an intermediate capacity between full capacity and zero capacity.

In another form, a compressor is provided and may include a shell assembly having a suction pressure region and a discharge pressure region. A first scroll member may be supported within the shell assembly and may have a first end plate, a first spiral wrap extending from a first side of the first end plate, a first chamber located on a second side of the first end plate having first and second passages in communication therewith, and a first aperture extending through the first end plate and in communication with the first chamber. A second scroll member may be supported within the shell assembly and may have a second end plate, a second spiral wrap extending from the second end plate and meshingly engaged with the first spiral wrap to form a series of compression pockets, and a second aperture extending through the second end plate. The first aperture may be in communication with a first of the compression pockets to provide communication between the first compression pocket and the first chamber. The second aperture may be in communication with a second of the compression pockets.

A capacity modulation assembly may include a first piston located within the first chamber and displaceable between first and second positions. The first piston may isolate the first passage from communication with the second passage when in the first and second positions. The first piston may prevent communication between the first aperture and the first passage when in the first position. The first piston may provide communication between the first aperture and the first passage when in the second position. A biasing member may bias the first piston in one of the first and second positions. A first actuation mechanism may be in communication with the second passage and may selectively provide a fluid to the second passage to overcome the biasing member and displace the first piston in another of the first and second positions.

A structure may support the second scroll member for orbital displacement relative to the first scroll member. The structure may include a second chamber generally aligned with the second aperture and third and fourth passages in communication therewith. A second piston may be located within the second chamber and axially displaceable between first and second positions. The second piston may isolate the third passage from communication from the fourth passage when in the first and second positions. The second piston may prevent communication between the second aperture and the third passage when in the first position. The second piston may provide communication between the second aperture and the third passage when in the second position. A second actuation mechanism may be in communication with a pressure source and the fourth passage and may selectively provide pressure to the fourth passage to displace the second piston between the first and second positions.

In another form, a compressor may include a first scroll member having a first end plate, a first spiral wrap extending from a first side of the first end plate, a first chamber located on a second side of the first end plate having first and second passages in communication therewith, and a first aperture extending through the first end plate and in communication with the first chamber. A second scroll member may have a second end plate, a second spiral wrap extending from the second end plate and meshingly engaged with the first spiral wrap to form a series of compression pockets, and a second aperture extending through the second end plate. The first piston may be located within the first chamber and may be displaceable between first and second positions. The first piston may prevent communication between the first aperture and the first passage when in the first position, and the first piston may provide communication between the first aperture and the first passage when in the second position.

A structure may support the second scroll member for orbital displacement relative to the first scroll member and may include a recess generally aligned with the second aperture and third and fourth passages in communication with the recess. A second piston may be located within the recess and may be axially displaceable between first and second positions. The second piston may prevent communication between the second aperture and the third passage when in the first position, and the second piston may provide communication between the second aperture and the third passage when in the second position.

The first piston may be in the first position and the second piston may be in the first position to provide a first level of capacity modulation. The first piston may be in the first position and the second piston may be in the second position to provide a second level of capacity modulation. The first piston may be in the second position and the second piston may be in the second position to provide a third level of capacity modulation. The first level of capacity modulation may be full capacity operation, the second level of capacity modulation may be operation at a capacity less than the first level of capacity modulation, and the third level of capacity modulation may be operation at a capacity less than the second level of capacity modulation.

In some embodiments, the first piston abuts the first end plate and the second piston abuts the second end plate when operating in the first level of capacity modulation.

In some embodiments, the first piston abuts the first end plate and the second piston abuts the fourth passage when operating in the second level of capacity modulation.

In some embodiments, the first piston abuts an annular ring and the second piston abuts the fourth passage when operating in the third level of capacity modulation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
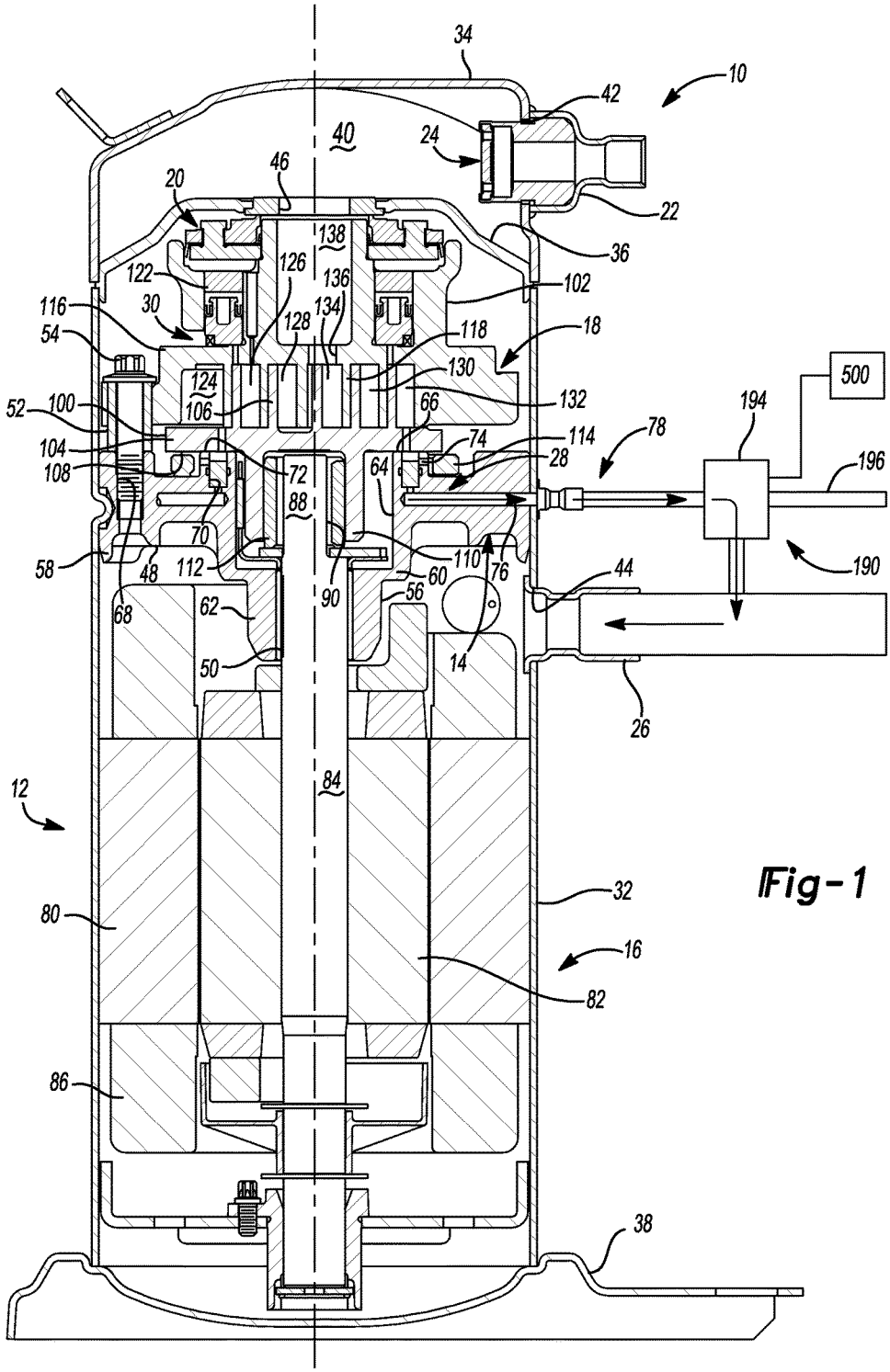
FIG. 1 is a cross-sectional view of a compressor according to the present disclosure.

The following description is merely exemplary in nature and is not intended to limit the present disclosure, application, or uses. It should be understood that throughout the drawings, corresponding reference numerals indicate like or corresponding parts and features.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present teachings are suitable for incorporation in many different types of scroll and rotary compressors, including hermetic machines, open-drive machines and non-hermetic machines. For exemplary purposes, a compressor 10 is shown as a hermetic scroll refrigerant-compressor of the low-side type (i.e., where the motor and compressor are cooled by suction gas in the hermetic shell), as illustrated in the vertical section shown in FIG. 1.

With reference to FIG. 1, compressor 10 is provided and may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, a first modulation assembly 28, and a second modulation assembly 30. Shell assembly 12 may house main bearing housing assembly 14, motor assembly 16, and compression mechanism 18.

Shell assembly 12 may generally form a compressor housing and may include a cylindrical shell 32, an end cap 34 at the upper end thereof, a transversely extending partition 36, and a base 38 at a lower end thereof. End cap 34 and partition 36 may generally define a discharge chamber 40. Discharge chamber 40 may generally form a discharge muffler for compressor 10. Refrigerant discharge fitting 22 may be attached to shell assembly 12 at opening 42 in end cap 34. Discharge valve assembly 24 may be located within discharge fitting 22 and may generally prevent a reverse-flow condition. Suction gas inlet fitting 26 may be attached to shell assembly 12 at opening 44. Partition 36 may include a discharge passage 46 therethrough, providing communication between compression mechanism 18 and discharge chamber 40.

Main bearing housing assembly 14 may be affixed to shell 32 at a plurality of points in any desirable manner, such as staking. Main bearing housing assembly 14 may include a main bearing housing 48, a first bearing 50 disposed therein, bushings 52, and fasteners 54. Main bearing housing 48 may include a central body portion 56 having a series of arms 58 extending radially outwardly therefrom. Central body portion 56 may include first and second portions 60, 62 having an opening 64 extending therethrough. Second portion 62 may house first bearing 50 therein. First portion 60 may define an annular flat thrust bearing surface 66 on an axial end surface thereof. Arm 58 may include apertures 68 extending therethrough and receiving fasteners 54.

Main bearing housing 48 may further include an annular passage 70 that forms an annular recess extending into thrust bearing surface 72. First radial passages 74 may extend radially through first portion 60 and into annular passage 70, providing communication between annular passage 70 and a suction pressure region. A second radial passage 76 may extend radially through first portion 60 and into annular passage 70 and may be in communication with capacity adjustment assembly 78, as discussed below.

Motor assembly 16 may generally include a motor stator 80, a rotor 82, and a drive shaft 84. Windings 86 may pass through stator 80. Motor stator 80 may be press fit into shell 32. Drive shaft 84 may be rotatably driven by rotor 82. Rotor 82 may be press fit on drive shaft 84. Drive shaft 84 may include an eccentric crank pin 88 having a flat 90 thereon.

Compression mechanism 18 may generally include an orbiting scroll 100 and a non-orbiting scroll 102. Orbiting scroll 100 may include an end plate 104 having a spiral vane or wrap 106 on the upper surface thereof and an annular flat thrust surface 108 on the lower surface. Thrust surface 108 may interface with annular flat thrust bearing surface 66 on main bearing housing 48. A cylindrical hub 110 may project downwardly from thrust surface 108 and may have a drive bushing 112 rotatively disposed therein. Drive bushing 112 may include an inner bore in which crank pin 88 is drivingly disposed. Crank pin flat 90 may drivingly engage a flat surface in a portion of the inner bore of drive bushing 112 to provide a radially compliant driving arrangement. An Oldham coupling 114 may be engaged with the orbiting scroll 100 to prevent relative rotation between the orbiting and non-orbiting scrolls 100, 102.

With additional reference to FIGS. 2-7, non-orbiting scroll 102 may include an end plate 116 having a spiral wrap 118 on a lower surface thereof, a series of radially outwardly extending flanged portions 120 (FIG. 5), and may receive an annular ring 122. Spiral wrap 118 may form a meshing engagement with wrap 106 of orbiting scroll 100, thereby creating an inlet pocket 124, intermediate pockets 126, 128, 130, 132, and an outlet pocket 134. Non-orbiting scroll 102 may be axially displaceable relative to main bearing housing assembly 14, shell assembly 12, and orbiting scroll 100. Non-orbiting scroll 102 may include a discharge passage 136 in communication with outlet pocket 134 and an upwardly open recess 138 that may be in fluid communication with discharge chamber 40 via discharge passage 46 in partition 36.

Flanged portions 120 may include openings 140 formed therethrough. Openings 140 may receive respective bushings 52 therein which, in turn, receive respective fasteners 54. Fasteners 54 may be engaged with main bearing housing 48 and bushings 52 may generally form a guide for axial displacement of non-orbiting scroll 102. Fasteners 54 may additionally prevent rotation of non-orbiting scroll 102 relative to main bearing housing assembly 14.

Non-orbiting scroll 102 may include an annular recess 142 in the upper surface thereof defined by parallel, coaxial inner and outer side walls 144, 146. Annular ring 122 may be disposed within annular recess 142 and may separate annular recess 142 into first and second annular recesses 148, 150 that are isolated from one another. First annular recess 148 may provide for axial biasing of non-orbiting scroll 102 relative to orbiting scroll 100, as discussed below. More specifically, a passage 152 may extend through end plate 116 of non-orbiting scroll 102, placing first annular recess 148 in fluid communication with one of intermediate pockets 126, 128, 130, 132. While passage 152 is shown extending into intermediate pocket 126, passage 152 may alternatively be placed in communication with any of the other intermediate pockets 126, 128, 130, 132.

Additional passages 154, 156 may extend through end plate 116, placing second annular recess 150 in fluid communication with two of intermediate fluid pockets 126, 128, 130, 132. Second annular recess 150 may be in fluid communication with different intermediate fluid pockets 126, 128, 130, 132 than first annular recess 148. More specifically, second annular recess 150 may be in fluid communication with intermediate fluid pockets 126, 128, 130, 132 located radially outwardly relative to the intermediate fluid pocket 126, 128, 130, 132 in fluid communication with first annular recess 148. Therefore, first annular recess 148 may operate at a pressure greater than an operating pressure of second annular recess 150. First and second radial passages 158, 160 may extend into second annular recess 150 and may cooperate with second modulation assembly 30, as discussed below.

Seal assembly 20 may include a floating seal located within first annular recess 148. Seal assembly 20 may be axially displaceable relative to shell assembly 12 and non-orbiting scroll 102 to provide for axial displacement of non-orbiting scroll 102 while maintaining a sealed engagement with partition 36 to isolate discharge and suction pressure regions of compressor 10 from one another. More specifically, pressure within first annular recess 148 may urge seal assembly 20 into engagement with partition 36 during normal compressor operation.

Second modulation assembly 30 may include a piston assembly 162, a solenoid 164, and a biasing member 168. Piston assembly 162 may include an annular piston 170 and first and second annular seals 172, 174. Annular piston 170 may be located in second annular recess 150 and first and second annular seals 172, 174 may be engaged with inner and outer side walls 144, 146 to separate second annular recess 150 into first and second portions 176, 178 that are isolated from one another. First portion 176 may be in communication with first radial passage 158 and second portion 178 may be in communication with second radial passage 160. Solenoid 164 may include a connecting passage 180 in fluid communication with a third radial passage 182 and with first radial passage 158. Accordingly, connecting passage 180 is in fluid communication with first annular recess 148 and first portion 176 via third radial passage 182 and first radial passage 158, respectively. Biasing member 168 may include a spring that is located in second portion 178 and is engaged with annular piston 170.

Annular piston 170 is displaceable between first and second positions. In the first position (FIGS. 2, 3, 5 and 6), annular piston 170 seals passages 154, 156 from communication with second portion 178 of second annular recess 150. Further, solenoid 164 is in a first position and provides communication between first portion 176 and first annular recess 148. In so doing, solenoid 164 provides first portion 176 with fluid at an intermediate pressure that is higher than suction pressure and lower than discharge pressure. The intermediate pressure fluid is communicated to first portion 176 via recess 148 and passages 182, 158, whereby recess 148 receives the intermediate pressure fluid from pocket 126 via passage 152. The force of the intermediate pressure fluid acts on annular piston 170, thereby causing piston 170 to engage and close passages 154, 156.

In the second position (FIGS. 4 and 7), annular piston 170 is displaced from passages 154, 156, providing communication between passages 154, 156 and second portion 178 of second annular recess 150. Solenoid 164 is likewise displaced to a second position to prevent communication between first portion 176 and first annular recess 148. In so doing, first portion 176 is placed under suction pressure, which allows biasing member 168 to move annular piston 170 away from and open passages 154, 156. Therefore, when annular piston 170 and solenoid 164 are in the second position, passages 154, 156 are placed in communication with a suction pressure region of compressor 10 via second radial passage 160 to provide a first reduced capacity operating mode for compressor 10.

Orbiting scroll 100 may include first and second passages 184, 186 extending through end plate 104 and providing communication between two of intermediate fluid pockets 126, 128, 130, 132 and annular passage 70. Intermediate fluid pockets 126, 128, 130, 132 in communication annular passage 70 may be different than intermediate fluid pockets 126, 128, 130, 132 in communication with annular recess 148. More specifically, intermediate fluid pockets 126, 128, 130, 132 in communication with annular recess 148 may be located radially inwardly relative to and operate at a pressure greater than intermediate fluid pockets 126, 128, 130, 132 in communication with annular passage 70.

First modulation assembly 28 may include a piston assembly 188, and a valve assembly 190. Piston assembly 188 may include an annular piston 192 located in annular passage 70. Annular piston 192 may be displaceable between first and second positions. In the first position (FIGS. 2 and 5), annular piston 192 isolates first and second passages 184, 186 from first radial passage 74. In the second position (FIGS. 3, 4, 6 and 7), annular piston 192 is displaced to provide communication between first and second passages 184, 186 and first radial passage 74. In the second position, first and second passages 184, 186 are in communication with a suction pressure region of compressor 10 via first radial passage 74 providing compressor 10 with a reduced capacity operating mode. In both the first and second positions, annular piston 192 isolates first and second radial passages 74, 76 from one another and additionally isolates first and second passages 184, 186 from second radial passage 76.

Valve assembly 190 may include a valve member 194 in communication with a pressure source 196 and with second radial passage 76. A biasing member (not illustrated) may be included in annular passage 70 and may be disposed between annular piston 192 and end plate 104. The biasing member may include a spring and may be engaged with annular piston 192 to bias piston 192 in a direction away from end plate 104. Valve assembly 190 may displace annular piston 192 between the first and second positions by selectively supplying radial passage 76 with pressurized fluid.

Valve member 194 may provide communication between pressure source 196 and second radial passage 76 to bias annular piston 192 to the first position. For example, the pressure source 196 may provide radial passage 76 with discharge pressure fluid from discharge chamber 40. Fluid at discharge pressure is at a pressure that is greater than an operating pressure of intermediate pockets 126, 128, 130, 132. Accordingly, the discharge pressure fluid overcomes the biasing force exerted on annular piston 192 by the biasing member disposed between annular piston 192 and end plate 104 and, as a result, maintains annular piston 192 in engagement with end plate 104. Further, the discharge pressure fluid in radial passage 76 is at a pressure that is greater than the intermediate pressure fluid disposed within passages 184, 186 acting on annular piston 192 and therefore maintains piston 192 in contact with end plate 104. Such engagement closes passages 184, 186 and prevents fluid communication between passages 184, 186 and suction pressure via radial passage 74.

Valve member 194 prevents communication between pressure source 196 and second radial passage 76 and may vent second radial passage 76 to a suction pressure region to allow annular piston 192 to be displaced to the second position. The biasing member disposed between annular piston 192 and end plate 104 may generally bias annular piston 192 to the second position when second radial passage 76 is vented to suction pressure.

Figure 2:
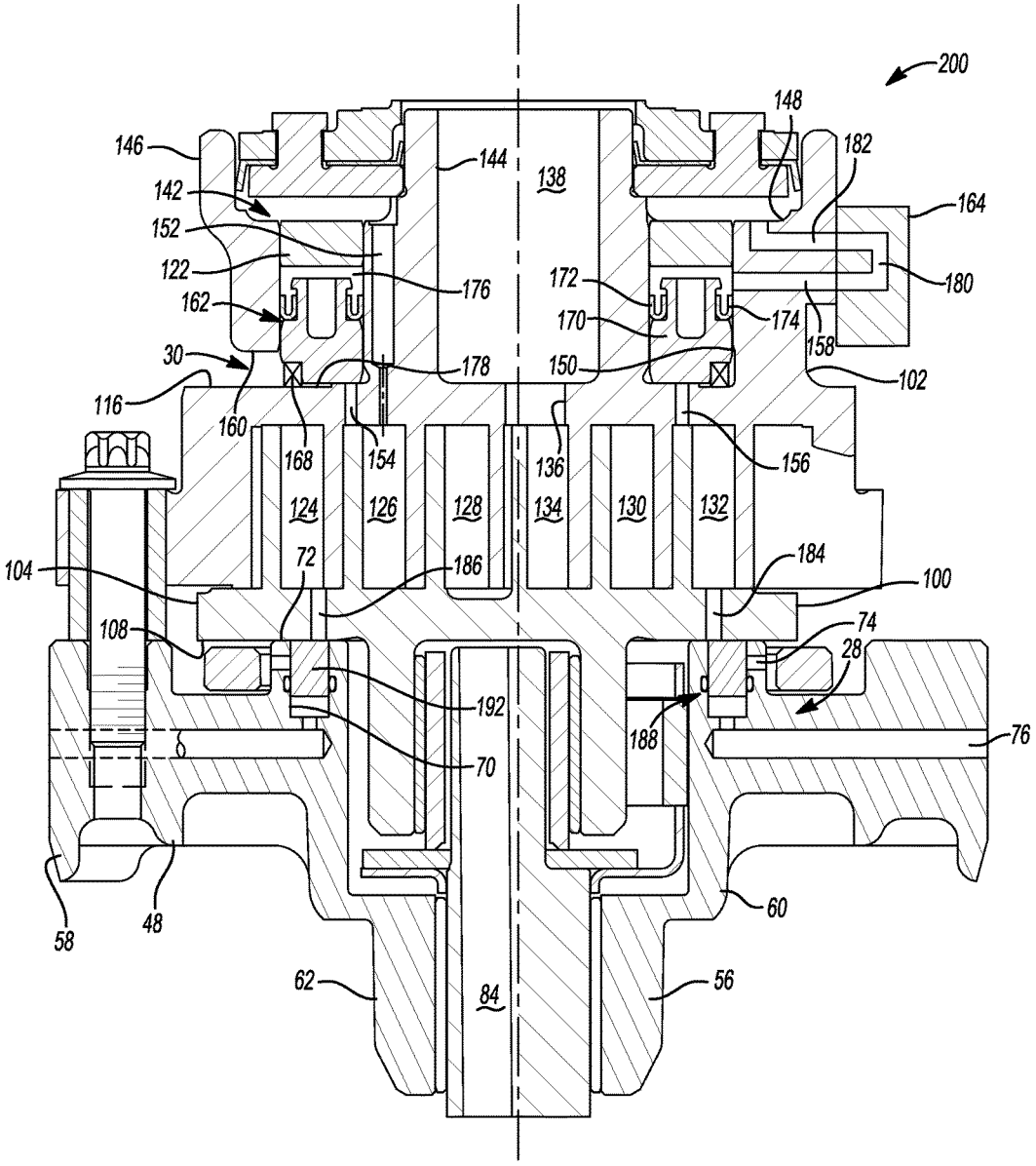
FIG. 2 is a cross-sectional view of an orbiting scroll, a non-orbiting scroll, a seal assembly, and a modulation system of the compressor of FIG. 1 showing the compressor in a full-capacity state.
Figure 3:
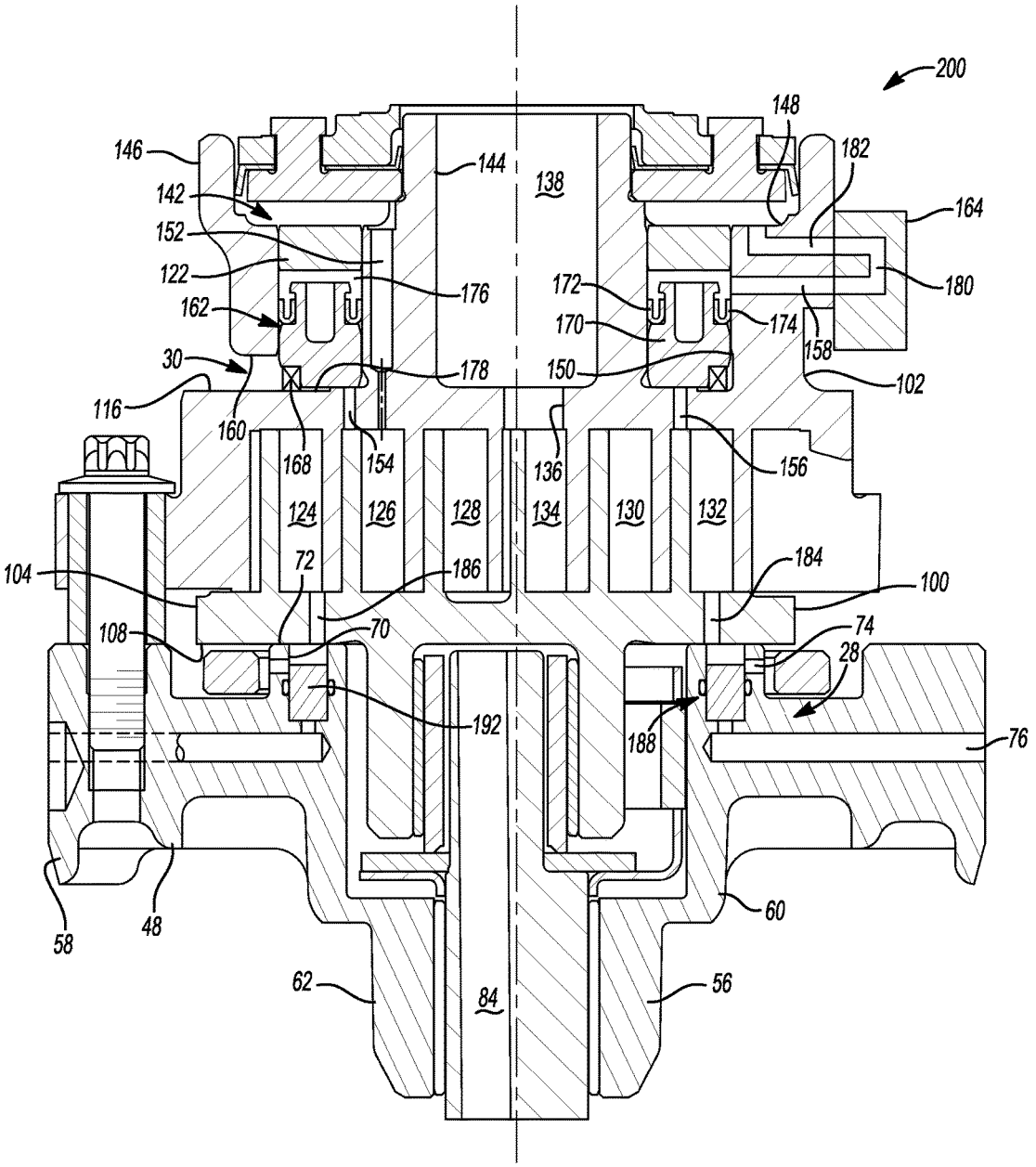
FIG. 3 is a cross-sectional view of an orbiting scroll, a non-orbiting scroll, a seal assembly, and a modulation system of the compressor of FIG. 1 showing the compressor in a reduced-capacity state.
Figure 4:
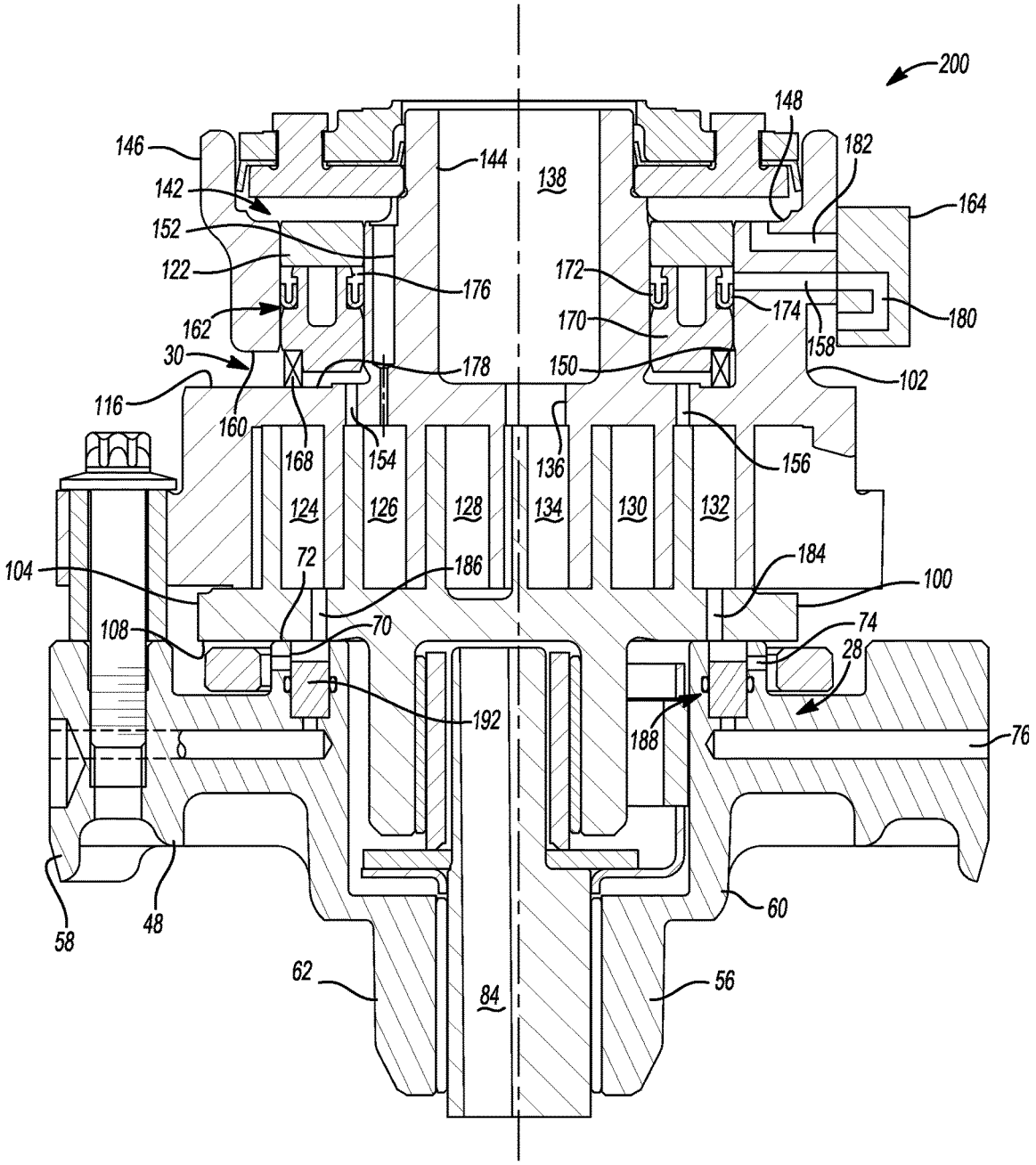
FIG. 4 is a cross-sectional view of an orbiting scroll, a non-orbiting scroll, a seal assembly, and a modulation system of the compressor of FIG. 1 showing the compressor in a reduced-capacity state.
Figure 5:
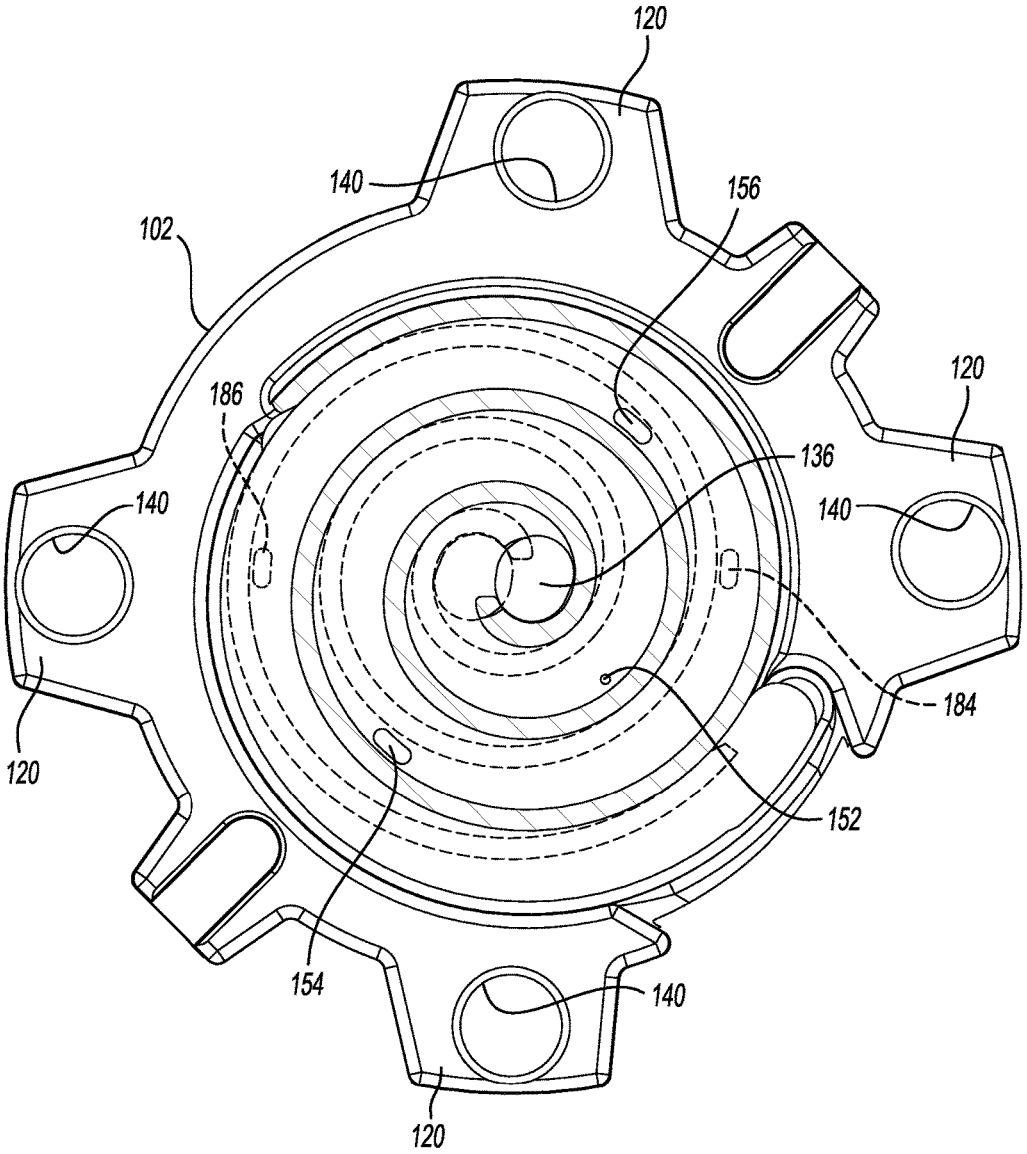
FIG. 5 is a plan view of an orbiting scroll and a non-orbiting scroll of the compressor of FIG. 1.

With reference generally to FIGS. 1-7, a three-step modulation system 200 is provided and may include a full-capacity mode or first level of capacity modulation, a modulation step-one mode or second level of capacity modulation, and a modulation step-two mode or third level of capacity modulation. Under the different modes of operation, compressor 10 selectively activates first modulation assembly 28 and second modulation assembly 30 to optimize a capacity of compressor 10. When annular pistons 192, 170 of the first modulation assembly 28 and second modulation assembly 30 are in the first position, compressor 10 operates at full capacity (FIGS. 2 and 5). When operating at full capacity, the entire compression cycle is utilized and compressor 10 achieves maximum performance (i.e., one hundred percent capacity).

Figure 6:
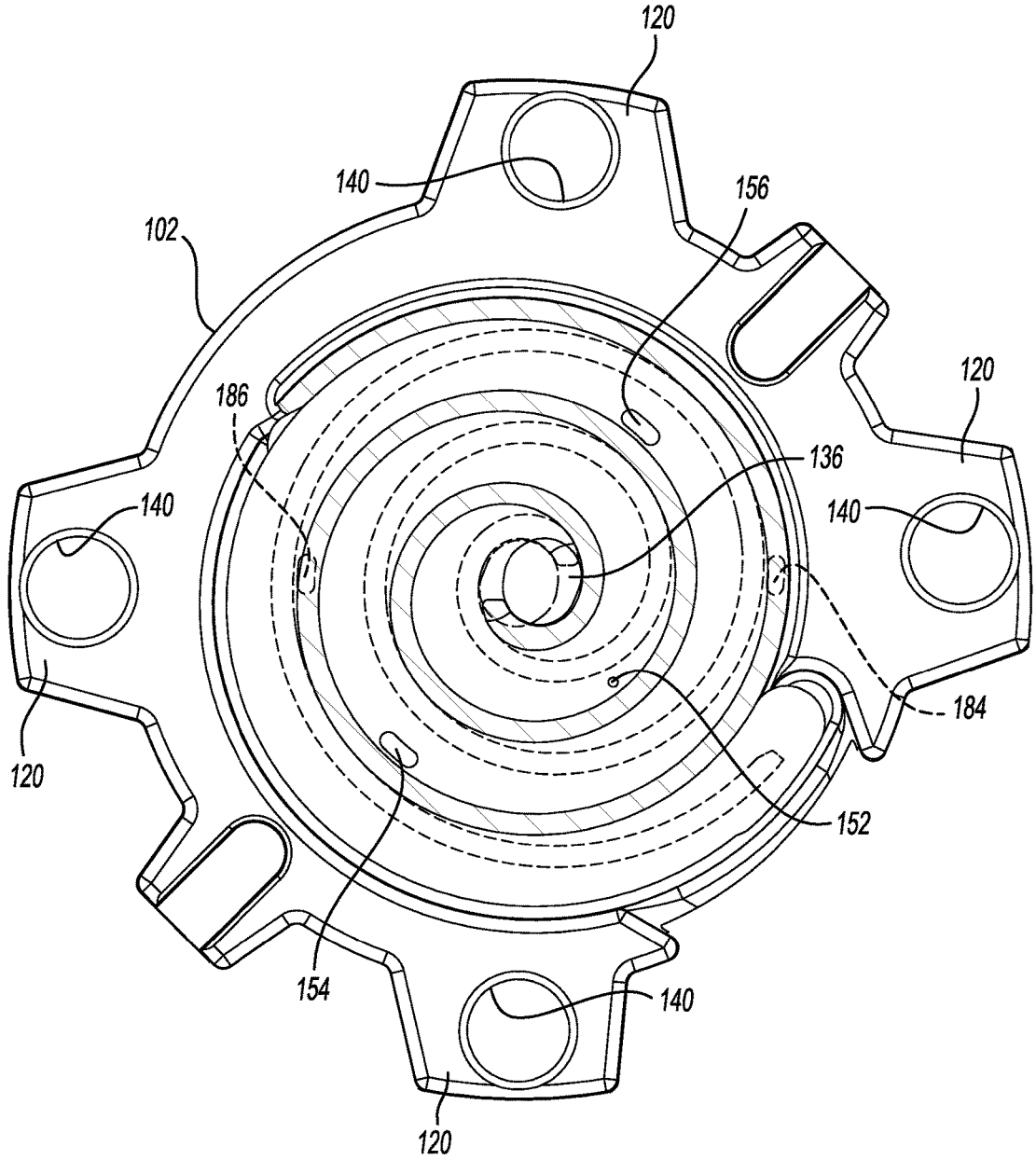
FIG. 6 is a plan view of an orbiting scroll and a non-orbiting scroll of the compressor of FIG. 1.

When valve member 194 of first modulation assembly 28 displaces annular piston 192 to the second position, second radial passage 76 is vented to suction pressure. When compressor 10 operates with annular piston 192 of first modulation assembly 28 in the second position, and annular piston 170 of second modulation assembly 30 in the first position, compressor 10 operates in modulation step-one mode (FIGS. 3 and 6). When operating in modulation step-one mode, compressor 10 operates at a reduced capacity from full capacity (roughly seventy percent total capacity). Namely, because annular piston 192 vents initial compression to suction pressure, the entire compression cycle is not utilized and as a result, the maximum possible output of compressor 10 is not achieved.

Figure 7:
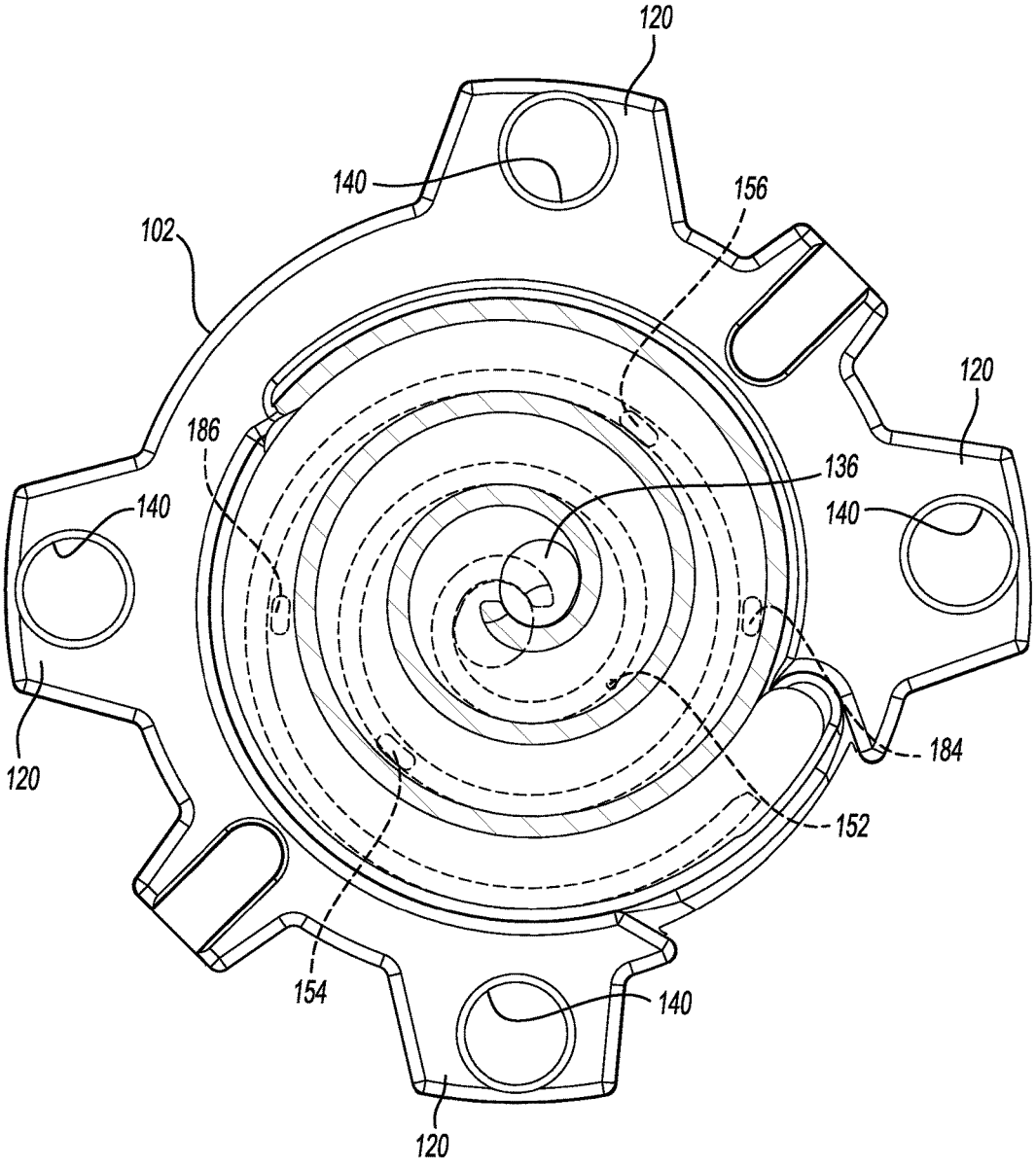
FIG. 7 is a plan view of an orbiting scroll and a non-orbiting scroll of the compressor of FIG. 1.

When annular piston 170 is displaced to the second position, passages 154, 156 are vented to a suction pressure region of compressor 10 through second radial passage 160. When compressor 10 operates with annular piston 170 of second modulation assembly 30 in the second position and annular piston 192 of first modulation assembly 28 in the second position, compressor 10 operates in modulation step-two mode (FIGS. 4 and 7). When operating in modulation step-two mode, compressor 10 operates at a reduced capacity when compared to modulation step-one mode (roughly fifty percent total capacity). Namely, because annular pistons 170, 192 vent initial compression to the suction pressure regions of compressor 10, the entire compression cycle is not utilized and, as a result, the maximum possible output of compressor 10 is not achieved. In fact, when compressor 10 is operating in step-two mode, an output of compressor 10 is less than when compressor 10 is operating in step-one mode.

Compressor 10 might operate at full capacity under normal circumstances and reduced capacity in the modulation step-one and modulation step-two modes based on a demand of a system (i.e., a refrigeration system) in which compressor 10 is installed. However, compressor 10 might also operate in modulation step-two in a normal operating mode and change to operate in modulation step-one or at full capacity if demand is increased. Further, compressor 10 might operate in modulation step-one and have the variability to increase capacity (with full capacity operation) or decrease capacity (with modulation step-two operation) if required.

Figure 8:
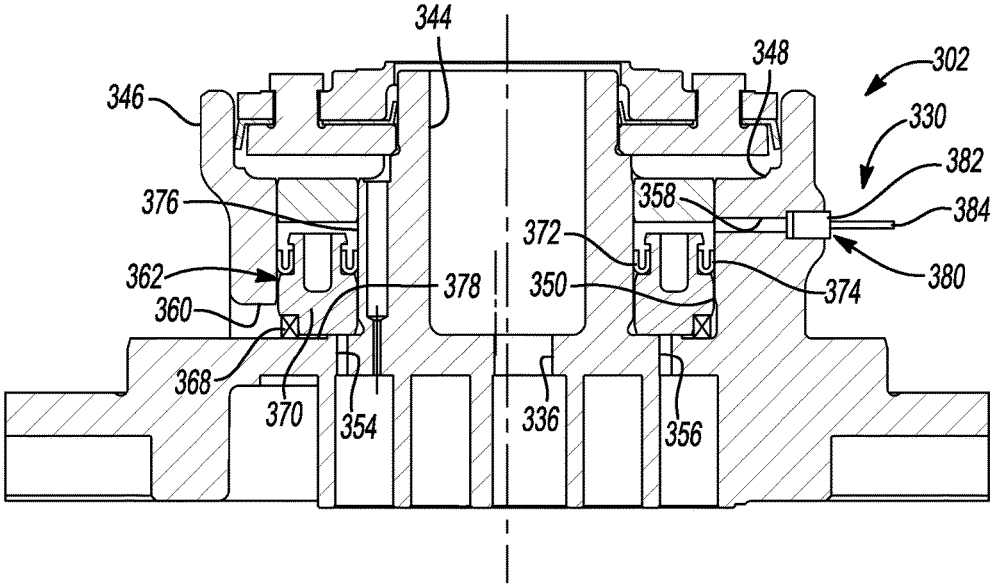
FIG. 8 is a cross-sectional view of a non-orbiting scroll, seal assembly, and modulation system according to the present disclosure.
Figure 9:
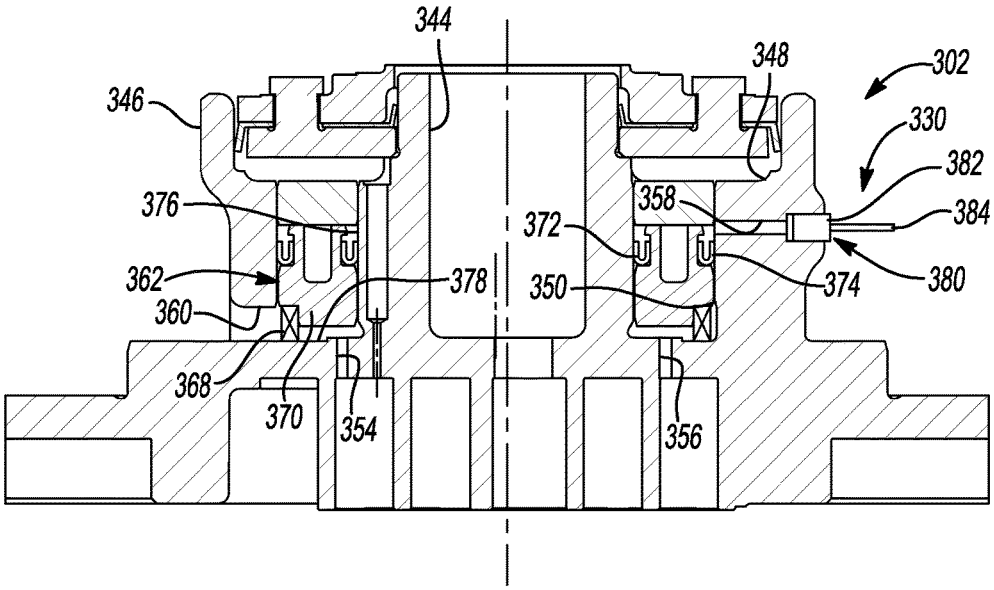
FIG. 9 is a cross-sectional view of the non-orbiting scroll, seal assembly, and modulation system of FIG. 8.

With reference to FIGS. 8 and 9, an alternate non-orbiting scroll 302 and modulation assembly 330 are shown. Non-orbiting scroll 302 may be generally similar to non-orbiting scroll 102. Therefore, the description of non-orbiting scroll 102 applies equally to non-orbiting scroll 302 with the exceptions indicated below. Further, non-orbiting scroll 302 and modulation assembly 330 may be incorporated into a compressor such as compressor 10 in place of non-orbiting scroll 102 and second modulation assembly 30 and may function in place of second modulation assembly 30 in the three-step modulation system.

Modulation assembly 330 may include a piston assembly 362, a valve assembly 380, and a biasing member 368.

Piston assembly 362 may include an annular piston 370 and first and second annular seals 372, 374. Annular piston 370 may be located in second annular recess 350 and first and second annular seals 372, 374 may be engaged with inner and outer side walls 344, 346 to separate second annular recess 350 into first and second portions 376, 378 that are isolated from one another. First portion 376 may be in communication with first radial passage 358 and second portion 378 may be in communication with second radial passage 360. Valve assembly 380 may include a valve member 382 in communication with a pressure source 384, with first radial passage 358, and with first portion 376. Biasing member 368 may include a spring and may be located in second portion 378 and may be engaged with annular piston 370.

Annular piston 370 may be displaceable between first and second positions. In the first position (FIG. 8), annular piston 370 may seal passages 354, 356 from communication with second portion 378 of second annular recess 350. In the second position (FIG. 9), annular piston 370 may be displaced from passages 354, 356, providing communication between passages 354, 356 and second portion 378 of second annular recess 350. Therefore, when annular piston 370 is in the second position, passages 354, 356 may be in communication with a suction pressure region of compressor 10 via second radial passage 360 providing a reduced-capacity operating mode for compressor 10.

Pressure source 384 may include a pressure that is greater than an operating pressure of intermediate pockets 126, 128, 130, 132. For example, pressure source 384 may be discharge-pressure fluid received from discharge chamber 40 (FIG. 1) and, therefore, may be at discharge pressure. Valve member 382 may provide communication between pressure source 384 and first portion 376 of second annular recess 350 to displace annular piston 370 to the first position. Valve member 382 may likewise prevent communication between pressure source 384 and first portion 376 of second annular recess 350 to displace annular piston 370 to the second position. Valve member 382 may additionally vent first portion 376 to the suction pressure region of compressor 10 to displace annular piston 370 to the second position. Biasing member 368 may generally bias annular piston 370 toward the second position. In addition, intermediate-pressure fluid disposed within compression pockets of compressor 10 may act on annular piston 370 to urge annular piston 370 away from passages 354, 356. Such intermediate-pressure fluid is permitted to move annular piston 370 away from passages 354, 356 when discharge-pressure fluid is not present in first portion 376.

Figure 10:
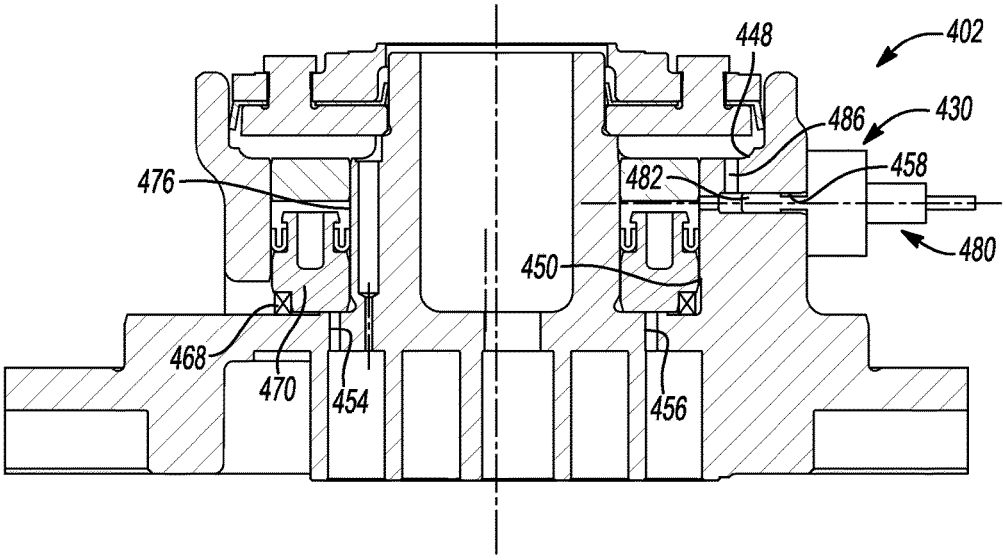
FIG. 10 is a cross-sectional view of a non-orbiting scroll, seal assembly, and modulation system according to the present disclosure.
Figure 11:
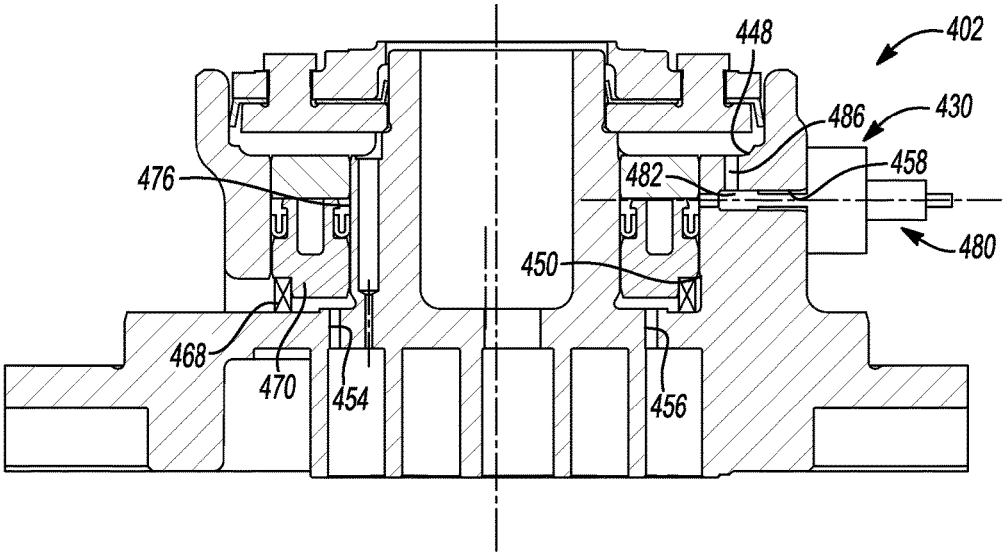
FIG. 11 is a cross-sectional view of the non-orbiting scroll, seal assembly, and modulation system of FIG. 10.

With reference to FIGS. 10 and 11, an alternate non-orbiting scroll 402 and modulation assembly 430 are shown. Non-orbiting scroll 402 may be generally similar to non-orbiting scroll 102. Therefore, the description of non-orbiting scroll 102 applies equally to non-orbiting scroll 402 with the exceptions indicated below. Further, non-orbiting scroll 402 and modulation assembly 430 may be incorporated into a compressor such as compressor 10 in place of non-orbiting scroll 102 and second modulation assembly 30 and may function in place of second modulation assembly 30 in the three-step modulation system.

Non-orbiting scroll 402 may include a passage 486 extending between and providing communication between first annular recess 448 and first portion 476 of second annular recess 450. Modulation assembly 430 may include a valve assembly 480 having a valve member 482 located in radial passage 458. Valve member 482 may be displaceable between first and second positions to displace annular piston 470 between first and second positions by selectively supplying first portion 476 with intermediate pressure fluid from annular recess 448. Namely, when valve member 482 supplies first portion 476 with intermediate pressure fluid, annular piston 470 is biased toward passages 454, 456. Conversely, when valve member 482 prevents intermediate pressure fluid from reaching first portion 476 by blocking passage 486 (FIG. 11), annular piston 470 moves away from and opens passages 454, 456 under the force of biasing member 468 and the intermediate pressure fluid disposed within passages 454, 456. The first and second positions of annular piston 470 and corresponding capacity reduction may be generally similar to that discussed above for second modulation assembly 30. Therefore, for simplicity, the description will not be repeated with the understanding that the above description applies equally to the modulation assembly 430.

Valve member 482 may provide communication between the first and second annular recesses 448, 450 when valve member 482 is in the first position (FIG. 10). Because first annular recess 448 operates at a higher pressure (i.e., intermediate pressure) than second annular recess 450, annular piston 470 may be displaced (or held) in the first position when valve member 482 permits intermediate pressure fluid to reach first portion 476 via passage 486. Valve member 482 may be displaced to the second position and vent first portion 476 of second annular recess 450 to suction pressure in order to displace annular piston 470 to the second position (FIG. 11). In the second position, valve member 482 may seal passage 486 to isolate first and second annular recesses 448, 450 from one another. When first and second annular recesses 448, 450 are isolated from one another, biasing member 468 may urge annular piston 470 to the second position where passages 454, 456 are in communication with a suction pressure region.

Referring to FIGS. 1-11, providing communication between the first annular recess 148, 348, 448 and the suction pressure region may remove the axial biasing force received from passage 152 that normally urges non-orbiting scroll 102, 302, 402 toward orbiting scroll 104. In so doing, a reduced compressor operating capacity is provided by causing axial separation of the non-orbiting scroll 102, 302, 402 from the orbiting scroll 100. The capacity is reduced to zero when the axial biasing force is removed and the axial clearance exists between the orbiting scroll 100 and the particular non-orbiting scrolls 102, 302, 402.

Figure 12:
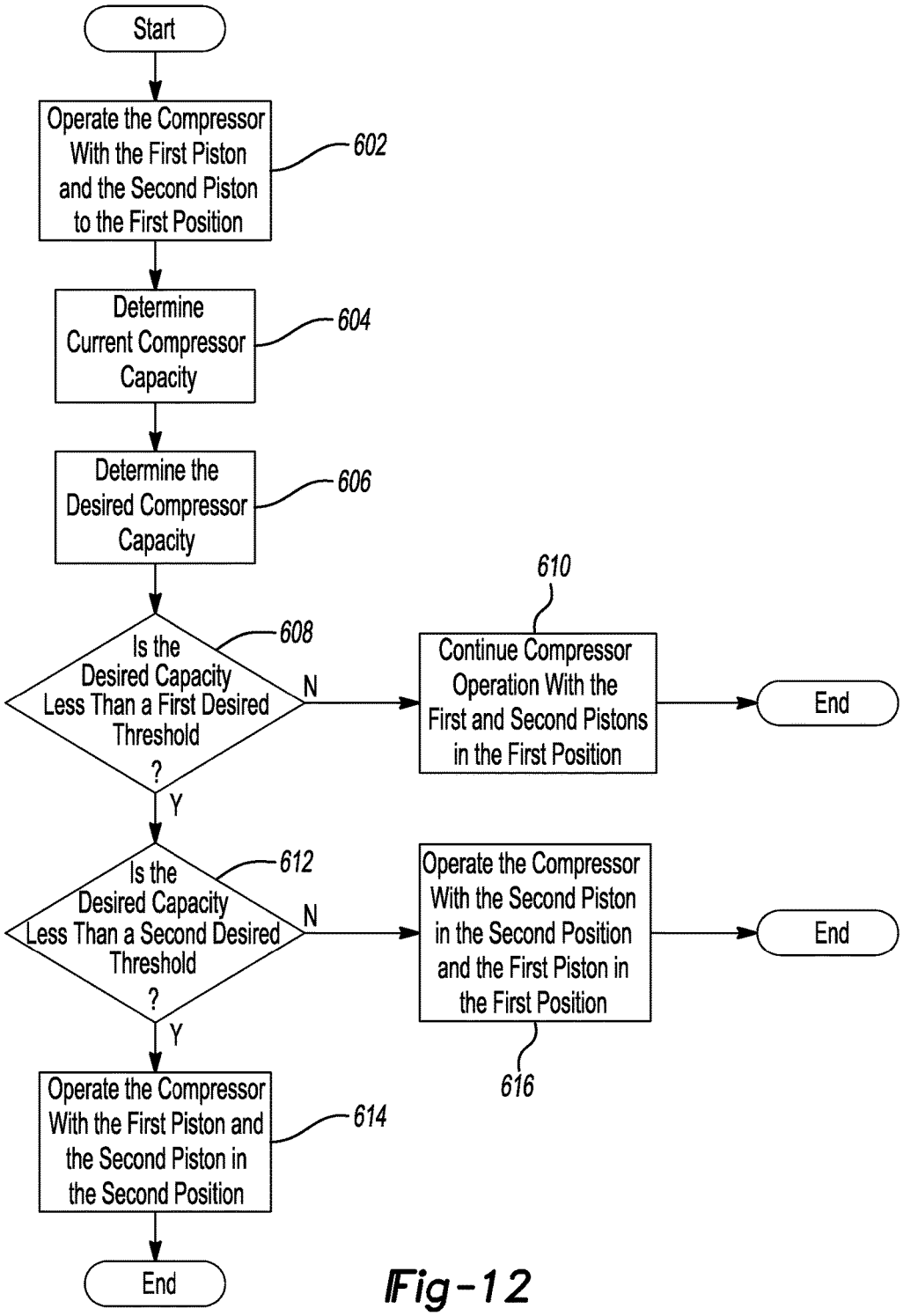
FIG. 12 is a flow diagram detailing operation of the compressors of FIGS. 1, 8, and 10.

Now referring to FIG. 12, a method 600 of controlling compressor 10 is illustrated. Method 600 operates compressor 10 with first annular piston 170 and second annular piston 192 in the first position at 602. While the method 600 will be described in conjunction with compressor 10 incorporating annular piston 170, compressor 10 could alternatively incorporate either of annular pistons 370, 470 in place of annular piston 170. Namely, a controller 500 (FIG. 1) associated with first modulation assembly 28 and second modulation assembly 30 controls solenoid 164 and valve member 194 to position first annular piston 170 and second annular piston 192 in the first position at 602. At 604, the current compressor capacity is determined. The current capacity may be determined from sensor readings or inputs from a user. At 606, the desired compressor capacity is determined. The desired capacity may be determined from a plurality of parameters entered by a user and/or based on sensor readings associated with compressor 10 and/or with a system in which compressor 10 is installed.

At 608, method 600 determines whether the desired capacity is less than a first desired threshold. The first desired threshold may be the threshold between the first level of capacity modulation and the second level of capacity modulation. The first desired threshold may be variable based on the application of compressor 10 and may be input by a user. If false, compressor 10 continues operation at the first level of capacity modulation, with first and second annular pistons 170, 192 in the first position, at 610.

If true at 608, method 600 determines whether the desired capacity is less than the second desired threshold at 612. The second desired threshold may be the threshold between the second level of capacity modulation and the third level of capacity modulation. The second desired threshold may be variable based on the application of the compressor and may be input by a user. If true, compressor 10 operates at the third level of capacity modulation, with first and second annular pistons 170, 192 in the second position, at 614. If false at 612, compressor 10 operates at the second level of capacity modulation, with first annular piston 170 in the first position and second annular piston 192 in the second position, at 616.

The flowchart of FIG. 12 provides a method 600 that operates compressor 10 with first annular piston 170 and second annular piston 192 in the first position at 602 under normal operating conditions. Namely, method 600 operates compressor 10 at full capacity under normal operating conditions. Compressor 10 could alternatively be operated such that compressor 10 operates in modulation step-one under normal operating conditions to allow a capacity of compressor 10 to be increased to full capacity if demand is increased and to allow a capacity of compressor 10 to be decreased to modulation step-two if demand is decreased. For example, compressor 10 could be operated under normal operating conditions at modulation step-one and could be moved to modulation step-two if less capacity is required (i.e., demand is decreased).

Similarly, compressor 10 could be operated at modulation step-two under normal operating conditions. If compressor 10 is operated at modulation step-two under normal operating conditions, a capacity of compressor 10 could be step-wise increased from modulation step-two to modulation step-one and from modulation step-one to full capacity. Determining whether to increase capacity of compressor 10 to modulation step-one or to full capacity may be dependent on how much demand is increased. For example, if compressor 10 is normally operated at modulation step-two and demand is only slightly increased, compressor 10 may be moved from modulation step-two to modulation step-one to satisfy the increased demand. Conversely, if compressor 10 is normally operated at modulation step-two and demand is significantly increased (i.e., more than a predetermined amount), compressor 10 may bypass modulation step-one and be operated at full capacity to satisfy demand.

In sum, regardless of whether compressor 10 is normally operated at full capacity (FIG. 12), modulation step-one, or modulation step-two, a capacity of compressor 10 may be adjusted based on demand to match compressor output with demand in an effort to increase the efficiency of compressor 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a housing including a discharge pressure region and a suction pressure region;

a first scroll member supported within said housing and having a first end plate, a first spiral wrap extending from a first side of said first end plate, a first annular recess located on a second side of said first end plate having first and second radial passages in communication therewith, and a first passage extending through said first end plate and in communication with said first annular recess;

a second scroll member supported within said housing and including a second end plate having a second spiral wrap extending therefrom and meshingly engaged with said first spiral wrap to form a series of compression pockets and a second passage extending therethrough, said first passage being in communication with a first of said compression pockets to provide communication between said first compression pocket and said first annular recess and said second passage being in communication with a second of said compression pockets; and a capacity modulation assembly including:

a first piston located within said first annular recess and displaceable between first and second positions, said first piston preventing communication between said first passage and said first radial passage when in the first position, and said first piston providing communication between said first passage and said first radial passage when in the second position;

a bearing housing supporting said second scroll member for orbital displacement relative to said first scroll member and including a second annular recess generally aligned with said second passage and third and fourth radial passages in communication with said second annular recess;

a second piston located within said second annular recess and axially displaceable between first and second positions, said second piston preventing communication between said second passage and said third radial passage when in the first position, and said second piston providing communication between said second passage and said third radial passage when in the second position;

a discharge passage extending through said first end plate and in communication with said discharge pressure region, and a third annular recess disposed radially outwardly of said discharge passage; and a solenoid having a communication passage selectively providing communication between said second radial passage and said third annular recess, wherein when said solenoid provides communication between said second radial passage and said third annular recess, said first piston is in said first position, and when said solenoid prevents communication between said second radial passage and said third annular recess, said first piston is in said second position.

2. The compressor of claim 1, further comprising a floating seal assembly engaged with said housing and said first scroll member to isolate said discharge pressure region from said suction pressure region.

3. The compressor of claim 2, wherein said first piston is located axially between said floating seal assembly and said first end plate.

4. The compressor of claim 2, wherein said first piston is axially displaceable relative to said floating seal assembly.

5. The compressor of claim 1, further comprising a spring that biases said first piston toward the second position.

6. The compressor of claim 1, wherein said first radial passage extends radially through said first scroll member and into said first annular recess, said second radial passage extends radially through said first scroll member and into said first annular recess, said third radial passage extends radially through said bearing housing and into said second annular recess, and said fourth radial passage extends radially through said bearing housing and into said second annular recess.

7. The compressor of claim 1, wherein said first piston abuts said first end plate when in the first position.

8. The compressor of claim 1, further comprising a valve assembly in communication with said second passage and selectively providing a pressurized fluid to said second passage to bias said first piston toward said first end plate.

9. The compressor of claim 1, wherein said first annular recess is an annular chamber, said second annular recess is an annular recess, said first piston is an annular piston, and said second piston is an annular piston.

10. The compressor of claim 1, wherein said first radial passage is in communication with said suction pressure region, said first passage being exposed to said suction pressure region when said first piston is in said second position to operate the compressor at a first capacity less than a full capacity.

11. The compressor of claim 10, wherein said third radial passage is in communication with said suction pressure region, said second passage being exposed to said suction pressure region when said second piston is in said second position to operate the compressor at a second capacity less than said first capacity.

12. The compressor of claim 11, wherein said second passage is disposed radially outward of said first passage.

13. The compressor of claim 1, further comprising a valve mechanism in communication with said fourth radial passage that selectively provides a pressurized fluid to said fourth radial passage to bias said second piston toward said second end plate.

14. The compressor of claim 1, wherein said second piston abuts said second end plate when in said first position.

15. The compressor of claim 1, further comprising a valve operable in a pulse width modulation capacity mode to operate the compressor at an intermediate capacity between a full capacity and a zero capacity.

16. A compressor comprising:

a shell assembly having a suction pressure region and a discharge pressure region;

a first scroll member supported within said shell assembly and having a first end plate, a first spiral wrap extending from a first side of said first end plate, a first annular recess located on a second side of said first end plate having first and second radial passages in communication therewith, and a first passage extending through said first end plate and in communication with said first annular recess;

a second scroll member supported within said shell assembly and having a second end plate, a second spiral wrap extending from said second end plate and meshingly engaged with said first spiral wrap to form a series of compression pockets, and a second passage extending through said second end plate, said first passage being in communication with a first of said compression pockets to provide communication between said first compression pocket and said first annular recess and said second passage being in communication with a second of said compression pockets; and a capacity modulation assembly including:

a first piston located within said first annular recess and displaceable between first and second positions, said first piston isolating said first radial passage from communication with said second radial passage when in the first and second positions, said first piston preventing communication between said first passage and said first radial passage when in the first position, and said first piston providing communication between said first passage and said first radial passage when in the second position;

a spring biasing said first piston in one of said first and second positions;

a discharge passage extending through said first end plate and in communication with said discharge pressure region, and a third annular recess disposed radially outwardly of said discharge passage;

a solenoid having a communication passage selectively providing communication between said second radial passage and said third annular recess, wherein when said solenoid provides communication between said second radial passage and said third annular recess, said first piston is in said first position, and when said solenoid prevents communication between said second radial passage and said third annular recess, said first piston is in said second position;

a bearing housing supporting said second scroll member for orbital displacement relative to said first scroll member and including a second annular recess generally aligned with said second passage and third and fourth radial passages in communication therewith;

a second piston located within said second annular recess and axially displaceable between first and second positions, said second piston isolating said third radial passage from communication from said fourth radial passage when in the first and second positions, said second piston preventing communication between said second passage and said third radial passage when in the first position, and said second piston providing communication between said second passage and said third radial passage when in the second position; and a valve in communication with a pressure source and said fourth radial passage and selectively providing pressure to said fourth radial passage to displace said second piston between said first and second positions.

17. A compressor comprising:

a first scroll member having a first end plate, a first spiral wrap extending from a first side of said first end plate, a first annular recess located on a second side of said first end plate having first and second radial passages in communication therewith, and a first passage extending through said first end plate and in communication with said first annular recess, a second scroll member having a second end plate, a second spiral wrap extending from said second end plate and meshingly engaged with said first spiral wrap to form a series of compression pockets, and a second passage extending through said second end plate;

a first piston located within said first annular recess and displaceable between first and second positions, said first piston preventing communication between said first passage and said first radial passage when in the first position, and said first piston providing communication between said first passage and said first radial passage when in the second position;

a bearing housing supporting said second scroll member for orbital displacement relative to said first scroll member and including a second annular recess aligned with said second passage and third and fourth radial passages in communication with said second annular recess, wherein said second passage extends vertically through said second end plate to provide communication between one of said series of compression pockets and said second annular recess;

a second piston located within said second annular recess and axially displaceable between first and second positions, said second piston preventing communication between said second passage and said third radial passage when in said first position, and said second piston providing communication between said second passage and said third radial passage when in said second position;

a discharge passage extending through said first end plate and in communication with said discharge pressure region, and a third annular recess disposed radially outwardly of said discharge passage; and a solenoid having a communication passage selectively providing communication between said second radial passage and said third annular recess, wherein when said solenoid provides communication between said second radial passage and said third annular recess, said first piston is in said first position, and when said solenoid prevents communication between said second radial passage and said third annular recess, said first piston is in said second position, said first piston being in said first position and said second piston being in said first position to provide a first level of a capacity modulation, one of said first and second pistons being in said first position and the other of said first and second pistons being in said second position to provide a second level of the capacity modulation, said first piston being in said second position and said second piston being in said second position to provide a third level of the capacity modulation, said first level of the capacity modulation being full capacity operation, said second level of the capacity modulation being operation at a capacity less than said first level of the capacity modulation, and said third level of the capacity modulation being operation at a capacity less than said second level of the capacity modulation.

18. The compressor of claim 17, wherein said first piston abuts said first end plate and said second piston abuts said second end plate when operating in said first level of the capacity modulation.

19. The compressor of claim 17, wherein said first piston abuts said first end plate and said second piston is spaced from said second end plate when operating in said second level of the capacity modulation.

20. The compressor of claim 17, wherein said first piston is spaced from said first end plate and said second piston abuts said second end plate when operating in said second level of the capacity modulation.

21. The compressor of claim 17, wherein said first piston abuts an annular ring and said second piston abuts said fourth radial passage when operating in said third level of the capacity modulation.

* * * * *